US005641066A

United States Patent [19]

Mascaro

[11] Patent Number: 5,641,066

[45] Date of Patent: Jun. 24, 1997

[54] ROTARY TOOL BIT STORAGE CASE

[76] Inventor: Gary Mascaro, 450 Jefferson La., Clinton, Tenn. 37716

[21] Appl. No.: 499,030

[22] Filed: Jul. 6, 1995

[51] Int. Cl.[6] ..... B65D 85/24

[52] U.S. Cl. ..... 206/372; 206/379; 206/486

[58] Field of Search ..... 206/349, 372, 206/373, 376, 377, 378, 379, 486

[56] References Cited

U.S. PATENT DOCUMENTS

| | | | |
|---|---|---|---|
| 3,171,566 | 3/1965 | Mitchell . | |
| 3,583,556 | 6/1971 | Wagner . | |
| 3,730,576 | 5/1973 | Schurman . | |
| 3,796,780 | 3/1974 | Schurman . | |
| 3,828,969 | 8/1974 | Schurman . | |
| 3,886,645 | 6/1975 | Schurman . | |
| 3,902,628 | 9/1975 | Schurman . | |
| 4,032,008 | 6/1977 | Vecchiarelli | 206/379 |
| 4,101,033 | 7/1978 | Schurman . | |
| 4,151,912 | 5/1979 | Harrold . | |
| 4,180,540 | 12/1979 | Schurman . | |
| 4,184,592 | 1/1980 | Howard, Jr. . | |
| 4,201,531 | 5/1980 | Schurman . | |
| 4,503,972 | 3/1985 | Nelligan et al. . | |
| 4,955,478 | 9/1990 | Rau et al. . | |
| 5,004,103 | 4/1991 | Connors et al. . | |
| 5,257,721 | 11/1993 | Smith et al. . | |
| 5,344,012 | 9/1994 | Matthews . | |
| 5,358,112 | 10/1994 | Gardner . | |
| 5,398,810 | 3/1995 | Yao Wang | 206/373 |

FOREIGN PATENT DOCUMENTS

| | | |
|---|---|---|
| 557208 | 2/1957 | Italy . |

*Primary Examiner*—Jacob K. Ackun

*Attorney, Agent, or Firm*—Luedeka, Neely & Graham, P.C.

[57] ABSTRACT

A rotary tool bit case suitable for both transport and storage of a multiplicity of such bits in a plurality of shank sizes without disorganization by inversion or vibration includes a double-wall molded thermoplastic casement base and hinged cover with a thick, shank aperture plate removably secured within the interior volume of the casement enclosure. Shank apertures within the plate are formed with a shank clearance of less than 3% of the plate thickness.

5 Claims, 5 Drawing Sheets

ROTARY TOOL BIT STORAGE CASE

BACKGROUND OF THE INVENTION

The present invention generally relates to tool storage cases. More particularly, the present invention relates to rotary tool bit cases that may be used for both storage and transport and maintain their original position and order when the case is inverted or shaken.

Craft artists and machinists frequently possess a large number of rotary tool bits of various shank sizes. Most of these tool bits are about the same length, however. Tool bits such as grinders and polishing heads include a large number of head shapes and sizes, each bonded or otherwise secured to the same diameter shaft or shank.

Although many of these craftsman keep their tools in some form of order for ease and efficiency of locating and retrieving the exact tool desired, prior art systems for order and storage are not particularly portable. In particular, prior art rotary tool storage cases and systems are not adapted to maintaining the preset order of the tools when inverted and/or shaken as frequently occurs if the storage case is transported.

It is, therefore, an object of the present invention to provide a compact and efficient storage case for rotary tool bits.

Another object of the present invention is to provide a portable carrying case for rotary tool bits.

A still further object of the present invention is a rotary tool bit case that substantially secures the stored bit from traveling or migrating within the case.

SUMMARY OF THE INVENTION

These and other objects of the invention are achieved by a clam-shell case of molded thermoplastic having interior and exterior wall shells respective to both, the case cover and base.

Tool storage volume is provided between the cover and base with a tool shank receptacle plate dividing the volume in a middle third volume portion between the cover and base. The acceptable plate is relatively thick and formed of thermoplastic material to include a multiplicity of apertures in the form of borings having one or more diameters that are determined by the bit shank sizes. A preferred relationship for the diametric clearance between a bit and its respective receptacle is about 3% of the plate thickness to keep the bits confined to reasonable alignment within the storage volume regardless of inversion, vibration or other disturbance.

The receptacle plate is removably secured to the base by a number of pliable, thermoplastic pawls which, by distortion, permit the plate to be selectively pushed past the pawls but upon a broad shelf substantially around the perimeter of the tool storage volume.

DESCRIPTION OF THE PREFERRED EMBODIMENT

Figure 1:
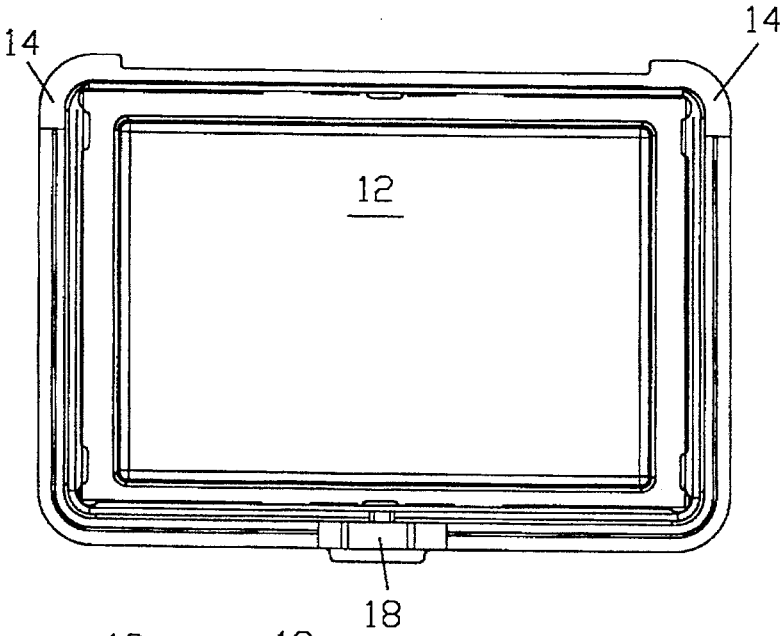
FIG. 1 is a top plan view of the present storage/carry case.
Figure 2:
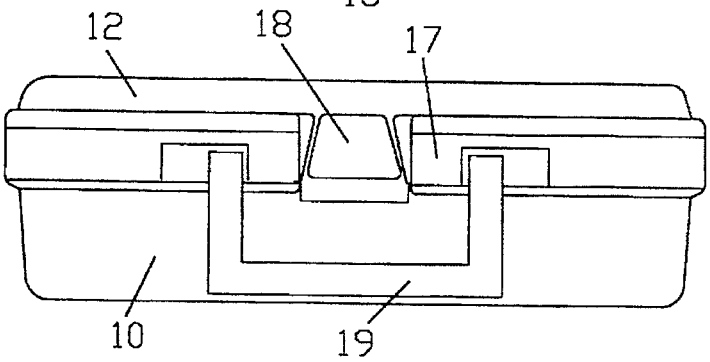
FIG. 2 is a front elevational view of the present storage/carry case.
Figure 3:
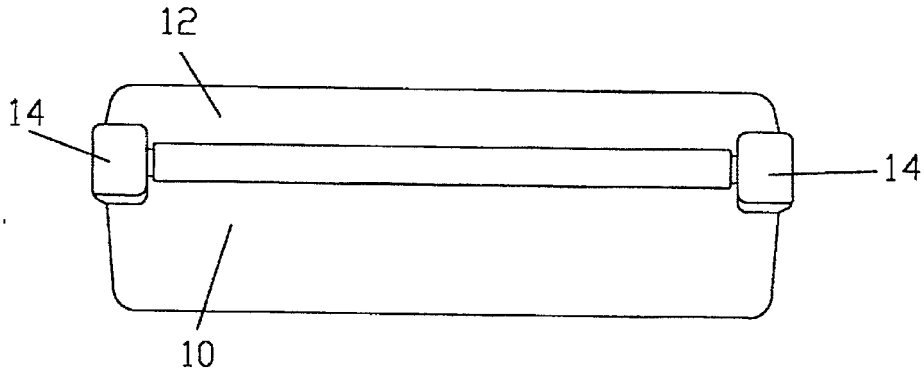
FIG. 3 is a rear elevational view of the present storage/carry case.
Figure 4:
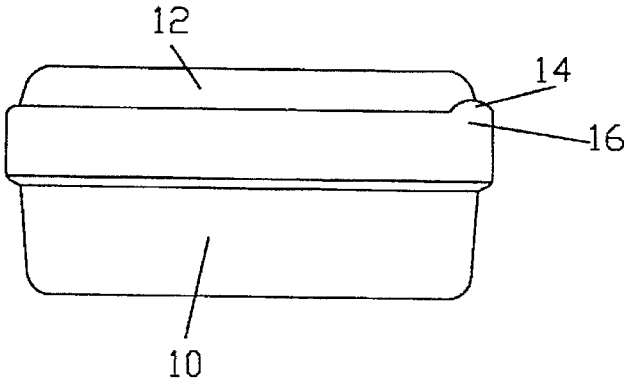
FIG. 4 is an end elevational view of the present storage/carry case.
Figure 5:
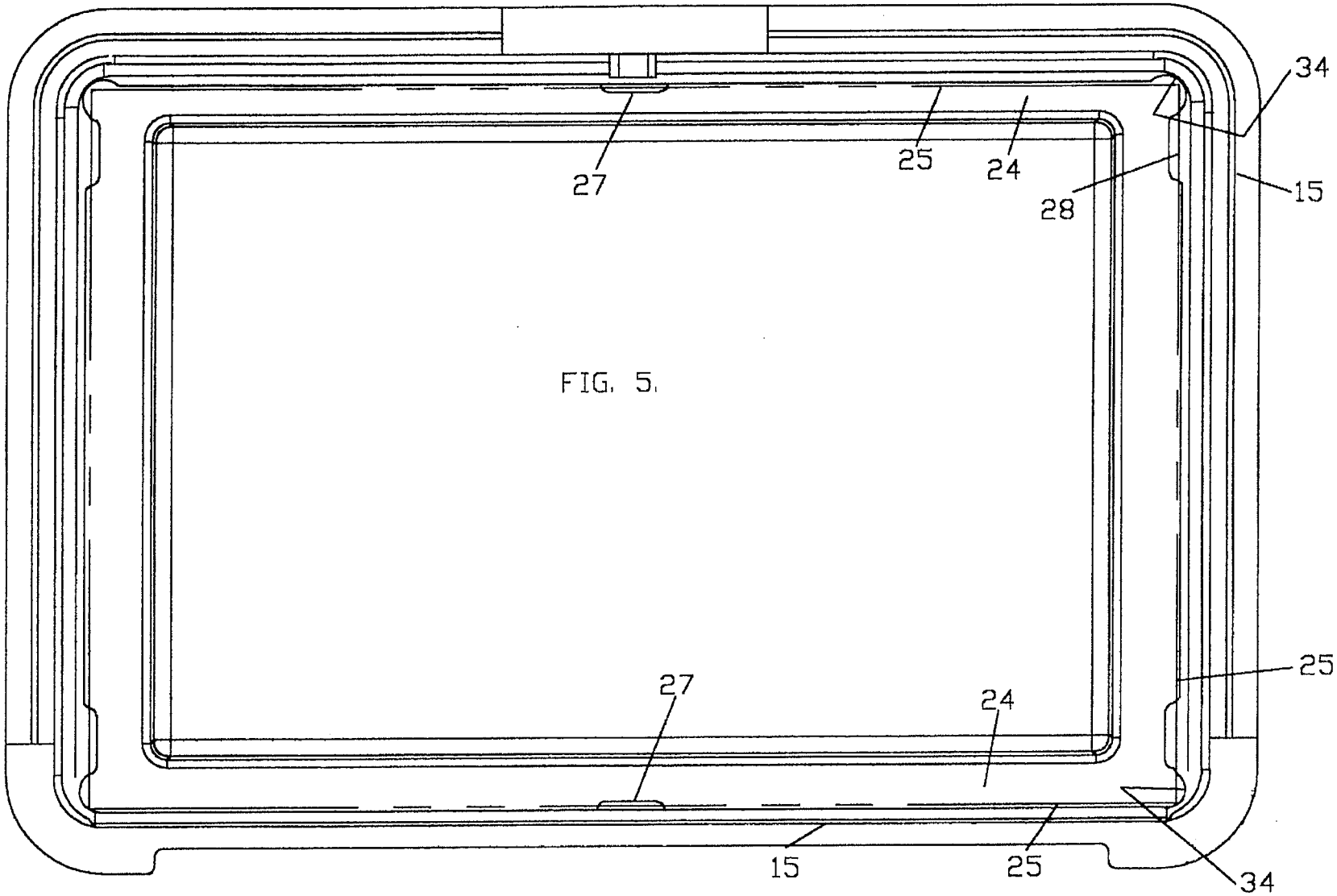
FIG. 5 is a top plan view of the open base of the case.
Figure 7:
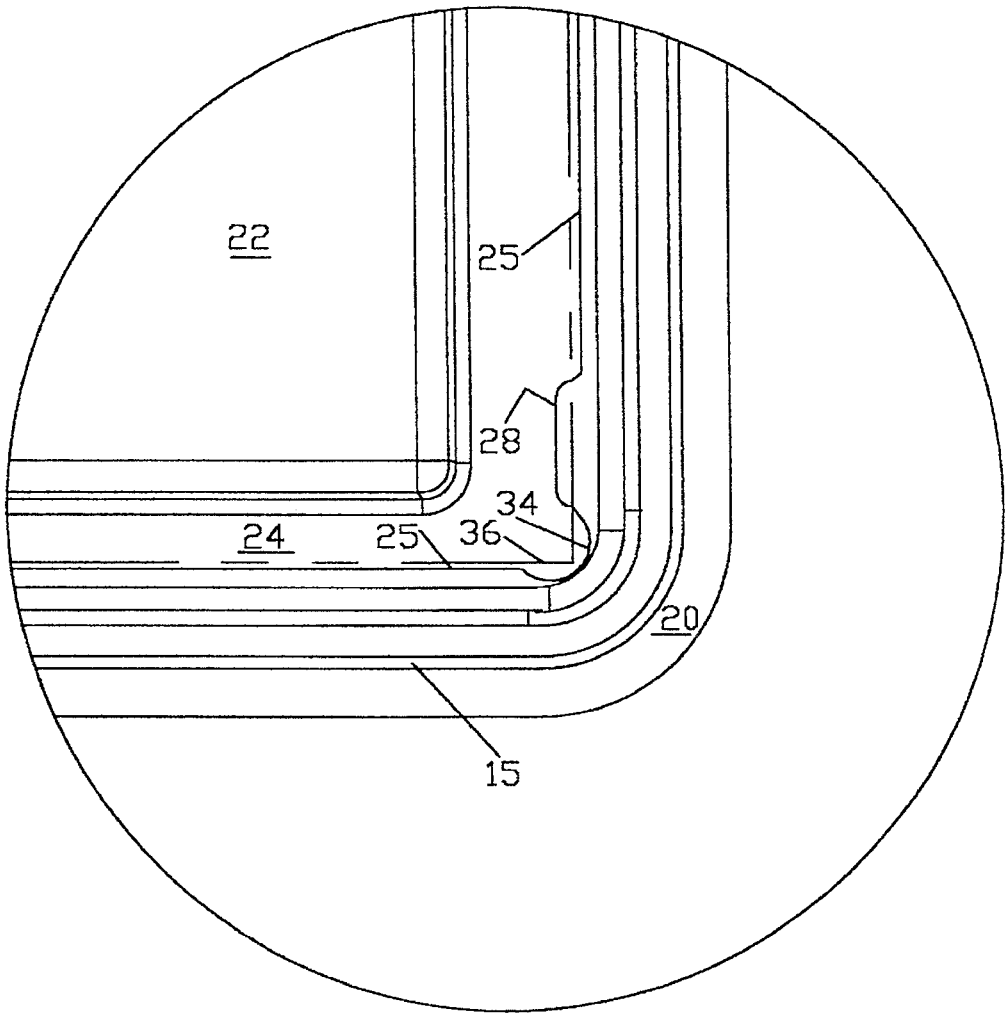
FIG. 7 is a top plan detail of the case corner.

Relative to the drawings wherein like reference characters designate like or similar elements throughout the several figures of the drawings, the case of the present invention comprises a base 10 and cover 12. The base and cover are joined along one material edge by hinge pin supporting hinge bosses 14 for relative rotation about the mutual axis 16.

A snap action latch 18 is an integral but thin flexible element extended from the cover 12 having a hinged functional connection to the cover body for holding the cover edge face against the base edge face when closure security is desired. The latch is flanked by a set of handle hinge bosses 17. Each hinge boss 17 supports a hinge pin which pivotally connects the journal ends of a pivoting carry handle 19.

Figure 6:
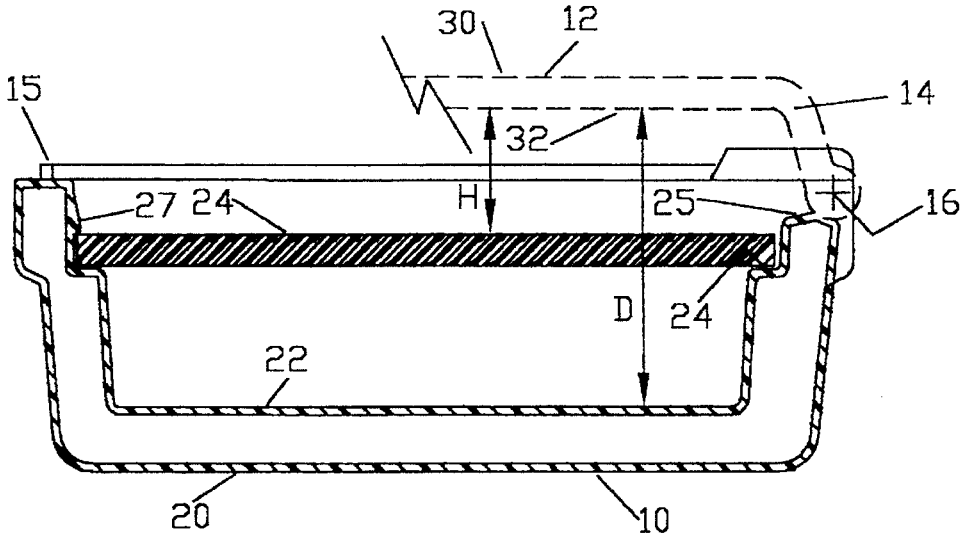
FIG. 6 is a sectional view of the case base along the end elevation perspective.

With respect to FIG. 6, both the base 10 and cover 12 are composites of molded inner and outer shells. Base 10 comprises outer shell 20 and inner shell 22. The cover 12, represented in FIG. 6 by dashed lines, comprises outer shell 30 and inner shell 32. When the cover 12 is closed upon the closure edge 15 of base 10 and latched, an internal volume is defined between the inner shells 22 and 32. The distance d between the opposing surfaces of these inner shells defines the total length of a tool bit suitable for placement in the case.

Molded into the surface profile of the base inner shell 22 is a ledge or shelf 24, preferably but not necessarily, extending around the entire interior volume perimeter in a flat plane to receive and support the tool retainer plate 26. At a distance spaced from the shelf 24 toward the closure edge 15 corresponding to the thickness of the tool retainer plate 26 are a number of deflection pawls 27 and 28. These pawls project from the planes of side walls 25 over the area encompassed by the outer edge perimeter 36 (shown in phantom line) of the tool retainer plate 26. This interference position requires a distorted displacement of the pawls 27 and 28 to position the tool retainer plate 26 against the surface of shell 24. With the retainer plate 26 in place against the shelf surface 24, the pawls 27 and 28 plastically return to their respective molded positions and shapes and provide and overlying ledge to confine the tool retainer plate against the shelf 24 even when inverted or shaken.

Removal of the tool retainer plate 24 is accomplished by a small relief volume 34 space notched into each of the base inner shell corners. This relief volume space permits the entry of a slender tool such as a screwdriver bit not shown into the space 34 and under the plate edge 36 as a lifting lever. Such concentrated force at a corner of the retainer plate 26 is effective to again, plastically distort the adjacent pawl and permit the tool retainer plate 26 to be extracted by prying.

Figure 8:
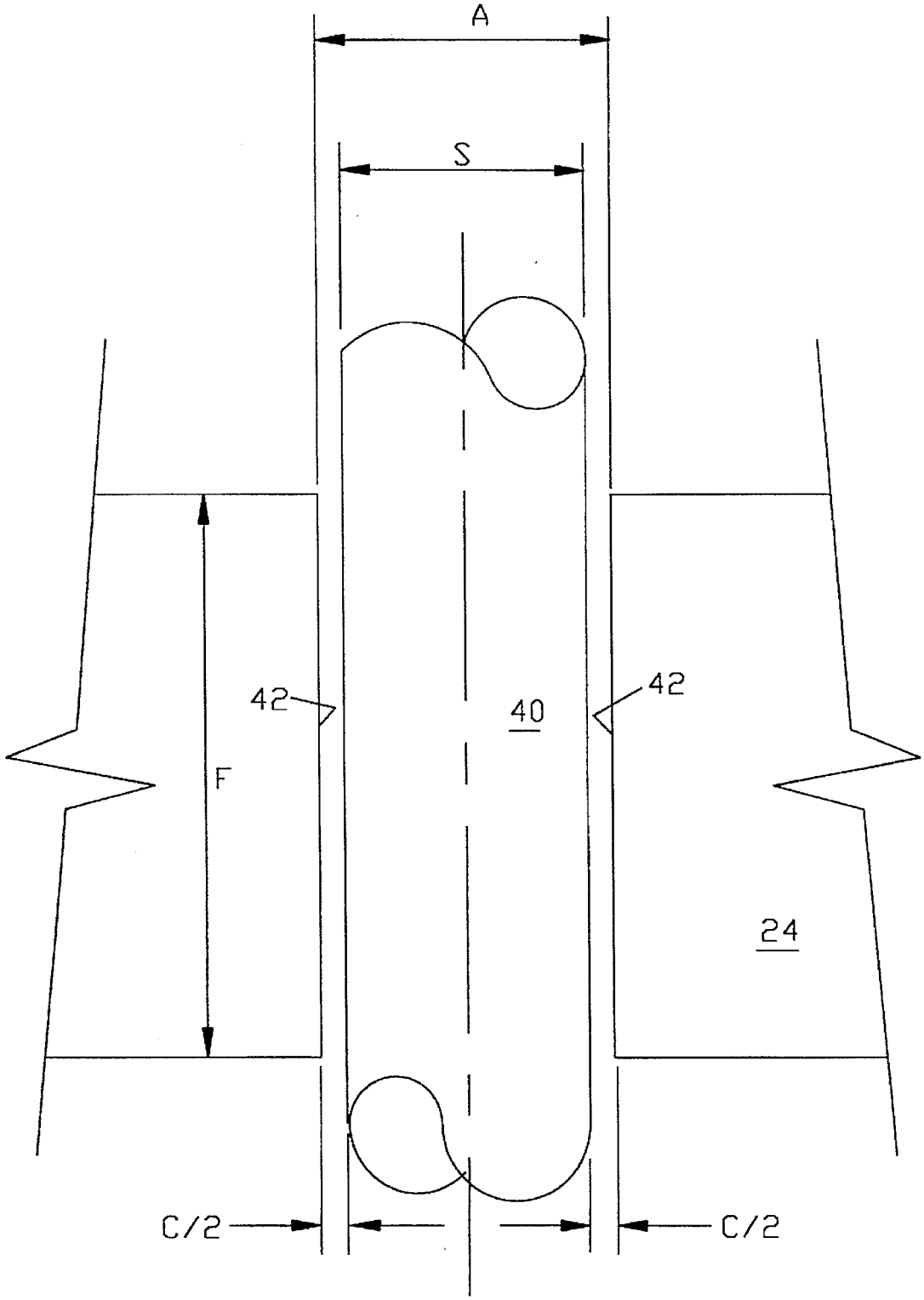
FIG. 8 is a dimensional detail of a tool retainer plate aperture and bit shank.

The thickness of tool retainer plate 76 is selected as a function of the largest tool shank diameter to be accommodated by the case. With respect to FIG. 8, a partial length tool shank 40 having a diameter, s, is shown to be coaxially centered within a tool retainer plate aperture having a diameter, a. The arithmetic difference between the diameters a and s corresponds to the tool clearance, c. Preferably, this tool clearance c should be less than 3% of the retainer plate thickness, t. For example, a ¼ in. (0.250) tool shank, may be secured within the 0.257 in. bore of an "F" size drill bit. The clearnace, c, of such a fit is 0.007 in. (0.257–0.250=0.007 in). This clearance of 0.007 in. is 2.8% of a ¼ in. plate 24 thicknesses.

In another example, the clearance between a #30 drill bit bore (0.128 in. dia.) and a ⅛ in. shank diameter is 0.003 in. which is 1.2% of a ¼ inch plate thickness. For a 3/32 in. tool shank socket, a #41 drill bit bore of 0.096 in. provides a clearance of 0.00225 in. which is 0.9% of a ¼" plate.

Figure 9:
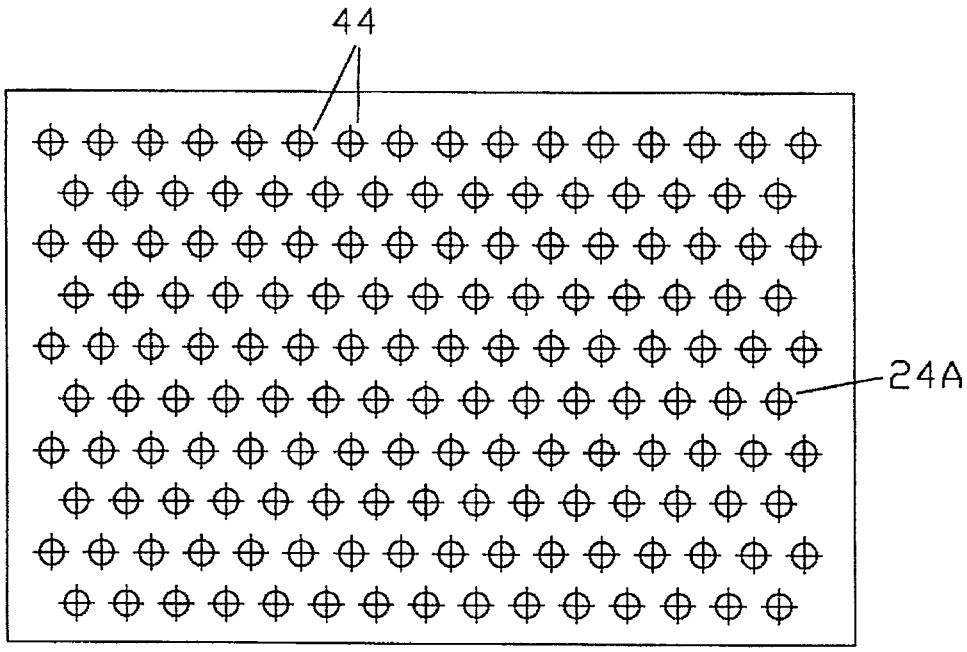
FIG. 9 is a plan view of a first tool receptacle plate embodiment.
Figure 10:
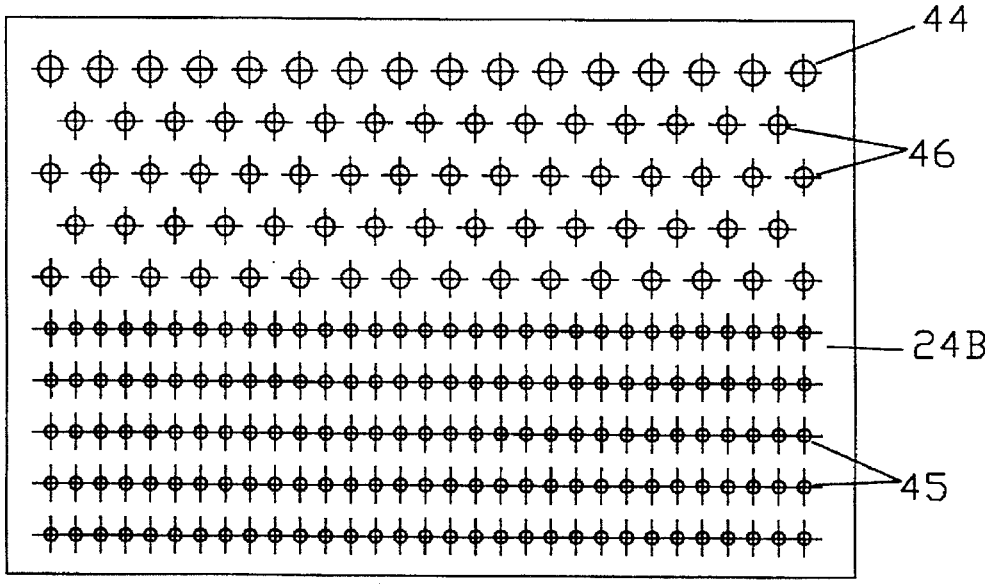
FIG. 10 is a plan view of a second tool receptacle plate embodiment.

In one configuration of a tool retainer plate 24A shown by FIG. 9, all of the tool socket apertures 44 of the same size are distributed over the plate surface area in an off-set matrix pattern substantially as shown. Another configuration, represented by plate 24B of FIG. 10, provides a normally aligned matrix pattern for 3/32 in. shank bit sockets 45 and an off-set matrix pattern for ⅛ in. shank bit sockets 46.

An optimum proportionality for the dimensional clearance, h, between the top or cover proximate surface of tool retainer plate 26 and the inner volume height d is about 1:2 thereby placing the plane of the retainer plate 26 upper surface at about midway between the oppositely facing surfaces of the inner shells 22 and 32. Fitting within this proportionality is a maximum tool head size of 1¼ in. to accommodate stone grinders, disc and cylinder sanders, carbide coated grinders, fluted grinders, rotary rasps, router bits, ruby cutters, diamond cutters, stump cutters, tertial cutters, rotary brushes, wire brushes, rotary polishing wheels and lab cutters. Any shank size from 3/32 to ½ in. may be accommodated.

Having fully disclosed my invention, those of ordinary skill in the art will perceive obvious alternatives and equivalents. As my invention, however,

I claim:

1. A rotary tool storage assembly comprising a casement base and a casement cover, each having respective exterior and interior shells formed of thermoplastic material, said casement base and cover being jointly hinged along one of several adjacent sides that meet along an interface therebetween and enclose an interior volume between respective interior shells, said interior volume having a height defined by the distance between the interior shells respective to the base and the cover in a closed position, a tool confining plate removedly attached to the interior shell of the base in a plane positioned within a central third of said interior volume height, said plate having a thickness between substantially parallel top and bottom plate surfaces and a plurality of substantially parallel apertures through said thickness aligned substantially transversely of said surfaces to receive rotary tool drive shanks therein, a plurality of rotary tools, each having an elongated drive shank of substantially uniform diameter about a length axis, each rotary tool shank being positioned in a respective aperture in substantial parallel axis alignment with other rotary tool shanks, said apertures having a diameter that is greater than the tool shank diameter by a difference value of less than about 3% of the plate thickness, each tool having an overall length that is no greater than said interior volume height and substantially no less than the distance between said bottom plate surface and the interior shell of said cover in said closed position.

2. A tool storage assembly as described by claim 1 wherein said plurality of rotary tools and apertures includes a plurality of tool shank and aperture diameters.

3. A tool storage assembly as described by claim 1 wherein the distance between said cover inner shell and said top plate surface is about 50% of said interior volume height.

4. A tool storage assembly as described by claim 1 wherein said interior base shell includes a planar shelf substantially around the perimeter of said interior volume to secure the position of said plate in a first direction.

5. A tool storage assembly as described by claim 4 wherein said interior base shell includes a plurality of pawls positioned from said shelf to releasably secure the position of said plate in a second direction substantially opposite from said first direction.

* * * * *